US009149097B1

(12) United States Patent
Davis

(10) Patent No.: US 9,149,097 B1
(45) Date of Patent: Oct. 6, 2015

(54) RADIANT HEATING UMBRELLA

(71) Applicant: Marvin Robert Davis, Capitola, CA (US)

(72) Inventor: Marvin Robert Davis, Capitola, CA (US)

( * ) Notice: Subject to any disclaimer, the term of this patent is extended or adjusted under 35 U.S.C. 154(b) by 0 days.

(21) Appl. No.: 14/656,330

(22) Filed: Mar. 12, 2015

(51) Int. Cl.
*A45B 23/00* (2006.01)
*F24C 1/12* (2006.01)

(52) U.S. Cl.
CPC . *A45B 23/00* (2013.01); *F24C 1/12* (2013.01); *A45B 2200/1009* (2013.01)

(58) Field of Classification Search
CPC ..... A45B 2023/0012; A45B 2025/003; A45B 2200/1009
USPC ..... 135/16; 126/92 AC, 92 B
See application file for complete search history.

(56) References Cited

U.S. PATENT DOCUMENTS 910,345 A * 1/1909 Akin ..... 126/40
3,885,582 A * 5/1975 Kowalski ..... 135/33.7
5,289,839 A * 3/1994 Lombardo ..... 135/33.7
5,964,233 A * 10/1999 Clark et al. ..... 135/16
6,192,878 B1 * 2/2001 Waters ..... 126/92 AC
6,336,450 B1 * 1/2002 Collet ..... 126/92 B
6,550,470 B2 * 4/2003 Liang ..... 126/92 B
6,938,631 B2 * 9/2005 Gridley ..... 135/94
7,828,002 B2 * 11/2010 Boldsen ..... 135/16
8,069,871 B2 * 12/2011 Schneider ..... 135/96

* cited by examiner

*Primary Examiner* — Noah Chandler Hawk
(74) *Attorney, Agent, or Firm* — Donald R. Boys; Central Coast Patent Agency, Inc.

(57) ABSTRACT

An apparatus having a radiant heater, an upwardly convex reflector, a vertically-oriented cylindrical ring shield joined to the reflector at the outside reflector diameter, an upwardly convex metal hood, and an upwardly convex cap having a cap diameter greater than the diameter of a hood opening, wherein exhaust gases emitted upwardly from the exhaust port draw cooler air through the cylindrical opening, the exhaust gases and cooler air pass upward through the hood, drawing additional cooler air through the annular space between the reflector and the hood, into a mixing chamber formed by the cap and the hood, where the cooler air and the exhaust gases mix and the mixed air and exhaust gases then pass outward through the annular space between the cap and the hood, exiting the apparatus at the outer diameter of the cap.

6 Claims, 4 Drawing Sheets

RADIANT HEATING UMBRELLA

BACKGROUND OF THE INVENTION

1. Field of the Invention

The present invention is in the field of heating apparatus for human comfort and pertains more particularly to methods and apparatus for heating in the vicinity of a patio umbrella and host dining or patio table.

2. Discussion of the State of the Art

There are a wide variety of outdoor heating apparatus that are available for space heating in outdoor or otherwise unheated settings. A typical fuel-burning radiant heater may be placed in an outdoor dining area, for example to provide radiant heat for patrons sitting within the influence sphere of the heater. Some businesses such as restaurants with an outdoor patio area have provided such heaters placed strategically throughout the patio dining area to provide such heating of the area.

A typical radiant heater currently available burns natural gas or propane. The heater operates at temperatures at which infrared radiant heat is produced. An annular or quasi-annular shield-type reflector redirects a small portion of the heat downward. Most of the heat travels outward heating objects in its path but not the air. A typical unit is tall, approximately 8 feet in height. The combustion chamber of the heater is supported by a hollow pillar with the reflector mentioned above located just above the heater to re-direct a small portion of the heat. Such heaters are large and cumbersome and may present as obstacles for patrons when placed in numbers to heat a general area, and can conflict with umbrellas in the same area.

The inventor is aware of a radiant heater integrated with a mechanically-operated patio umbrella that may be used in an outdoor dining area to eliminate the conflict, clutter and safety issues created by the use of separate heaters and umbrellas. This is U.S. Pat. No. 5,964,233 issued Oct. 12, 1999 to the present inventor and a joint inventor, now deceased. The estate of the deceased inventor has assigned all rights to the present inventor, and the assignment has been recorded.

In this prior apparatus the heater and chimney apparatus is integrated into the pole apparatus of the umbrella, the heater and a reflector mounted below the canopy support apparatus. The reflector redirects the heat downward and outward. Products of combustion are drawn up the chimney, forming a rising, concentrated column of hot gases. These gases eventually mix with the ambient air and are cooled to temperatures that can safely be in contact with combustible materials. A major drawback of this configuration is that the distance the gas must travel before cooling to a safe temperature is several times greater than for an unmodified patio heater. This is a major safety issue relating to building projections, trees and other overhanging objects. FIG. 3 of this prior-art patent is particularly indicative of the details of the apparatus that are improved upon by the present invention.

While the heated umbrella better utilizes available patio space than does a large cumbersome floor heater, there are several additional problems with current heated umbrellas. The center is open at the top and may allow rain to get into the controls and heater valve. Also, the center opening can allow leaves and other debris to clog the opening impeding the evacuation of combustion gases, and create a fire hazard from the ignition of trapped debris. Moreover, umbrella parts and fabric proximal to the upper edge of the canopy are exposed directly to heat, leading to overheating in those areas, often to beyond an acceptable level. These and still other problems ultimately affect safe operation of the umbrella heater of the prior art.

Therefore, what is clearly needed is an umbrella heating unit that solves the issues described above.

BRIEF SUMMARY OF THE INVENTION

In one embodiment of the invention an apparatus is provided, comprising a fuel-burning radiant heater radiating heat outwardly from the infra-red heat source, an upwardly convex reflector having an outside reflector diameter substantially greater than the outside perimeter of the radiant heater, the reflector having inner surfaces oriented to reflect radiant heat from the heater downward below the heater, the surfaces converging to an upper central opening, the reflector joined to the radiant heater with the center opening aligned with and spaced above the heater, a vertically-oriented cylindrical ring shield joined to the bottom of the reflector at the outside reflector diameter, the ring shield having a dimension extending downward to block radiant heat from passing horizontally beyond the outside reflector diameter, thus shielding a canopy from direct radiant heat, an upwardly convex metal hood having a hood diameter greater than the outside reflector diameter, and a hood opening concentric with and greater in diameter than the upper central opening of the reflector, the hood evenly spaced above the reflector by spacers between the reflector and the hood, providing an annular space between the hood and reflector; and an upwardly convex dome-shaped cap having a cap diameter greater than the diameter of the hood opening and less than the hood diameter, the cap spaced apart from the hood by spacers, providing an annular space between the cap and the hood of substantially a common height. Exhaust gases emitted upwardly from the radiant heater pass through the upper central opening of the reflector, drawing cooler air through the space between the heater and the reflector through the center opening of the reflector, the exhaust gases and cooler air pass upward through the hood opening, drawing additional cooler air through the annular space between the reflector and the hood, into a mixing chamber formed by the cap and the hood, where the cooler air and the exhaust gases mix and the mixed air and exhaust gases then pass outward radially through the annular space between the cap and the hood, exiting the apparatus at the outer perimeter of the cap.

In one embodiment the apparatus further comprises members joined to the reflector, extending radially to vertical supports reaching the ground, these members supporting a fabric canopy, and a support element supporting the reflector, and hence the heater and entire hood and cap assembly, at a height sufficient that persons may congregate beneath the canopy. Also in one embodiment the support element supporting the radiant heater is one of a post supported on a ground-level base, a post supported by a table and a table base, or a cantilever arm joined to a nearby structure. Also in one embodiment the support element supporting the radiant heater is a post, and the struts are joined to the reflector to be vertically hinged, such that the fabric canopy forms an umbrella that may be raised and lowered.

In one embodiment of the invention the apparatus further comprises a sliding collar on the post having ribs pivotally joined to both the collar and at a point on the struts, such that sliding the collar up and down raises and lowers the umbrella. Also in one embodiment the apparatus further comprises a proximity switch in the post sensing the collar, such that, at a specific point in lowering the umbrella the heater is disabled. And in one embodiment the apparatus further comprises an electronic or mechanical switch to ignite the heater and to count off the number of minutes that heat will be generated by the unit.

DETAILED DESCRIPTION OF THE INVENTION

In various embodiments described in enabling detail herein, the inventor provides a radiant heating umbrella that solves the problems of the prior art. The present invention is described using the following examples, which may describe more than one relevant embodiment falling within the scope of the invention.

Figure 1:
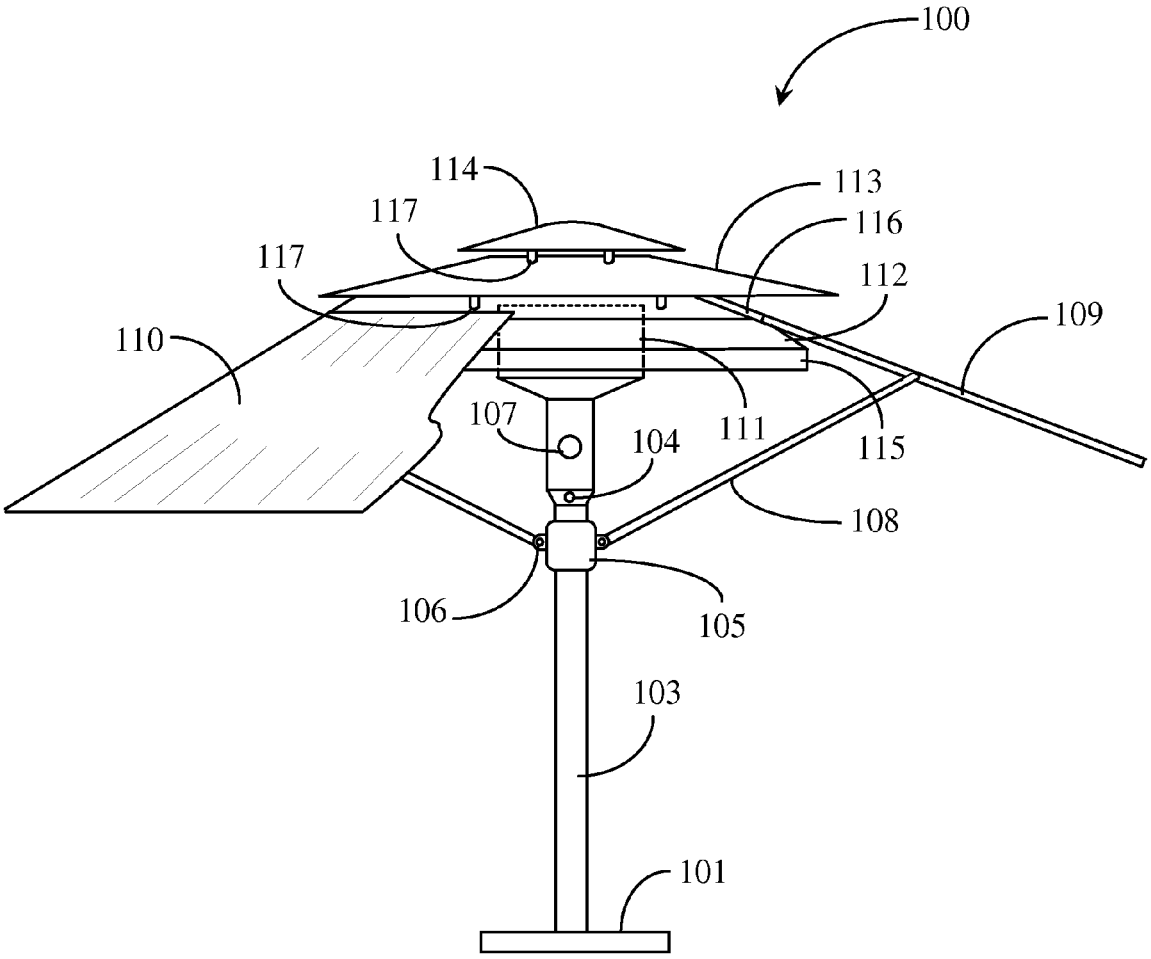
FIG. 1 is an elevation view of a radiant heater unit according to an embodiment of the present invention.

FIG. 1 is an elevation view of a radiant heater unit 100 according to an embodiment of the present invention. Heater unit 100 is in the form of a patio umbrella that has been manufactured or otherwise modified to incorporate a heater core 111 as a source of radiant heat available through operation of the umbrella. Radiant heater unit 100 may be referred to in this specification as umbrella 100.

Umbrella 100 has a base portion 101. Base portion 101 includes a platform and upright tubular or otherwise hollow body 103 manufactured of a resilient and durable material such as steel, aluminum, high grade polymer or other resilient materials. In one embodiment, base 101 is weighted to provide vertical support for the umbrella portion of the unit. In one embodiment, base 101 may have an added cylindrical structure (not illustrated) to enclose an accessible fuel tank that is tethered to heater core 111 by a fuel line (not illustrated) concealed in a vertical tubular member 103 that supports the umbrella mechanical components. In this embodiment the unit is self contained and portable. In another embodiment, base portion 101 may be connected to an external fuel supply by a fuel line, perhaps running under the floor beneath the unit.

In one embodiment tubular member 103 supports a table top not illustrated. The table top may be any standard table top material or configuration (shape) without departing from the spirit and scope of the present invention. The table top may be formed contiguously with or may be separate from but mounted or affixed to member 103. In one embodiment the table may be supported by the fuel tank enclosure and have a center through-opening adapted to help seat tubular member 103 in a vertical position for operation of the umbrella mechanics.

Tubular member 103 may be manufactured of stainless steel or another resilient and durable material. Tubular member 103 supports heater core 111. Heater core 111 is centrally mounted over the upward facing end of tubular member 103 and includes a combustion chamber surrounded by an emitter grid that is heated to the temperature where radiant heat is generated. In a preferred embodiment, heater core 111 is plumbed to the end of tubular member 103 protecting fuel lines and fuel line connection to the combustion chamber. Heater core 111 may be any type of heater without departing from the spirit and scope of the present invention. Heater core 111 may burn propane and or natural gas, or another suitable fuel without departing from the spirit and scope of the present invention.

A table resting on a fuel tank enclosure as described above is but one example of how an umbrella with a heating core may be supported and used in embodiments of the present invention. There are a variety of other ways that the umbrella may be supported to be used. For example, an umbrella and heater according to an embodiment of the invention may be supported from a cantilevered support member that may be anchored on, for example, a building member or other support from the ground. In this case the support member to which the umbrella may be attached may pivot through an arc, allowing the umbrella to be repositioned from one area to another. As another example, post 103 may not integrate with a table at all, but may interface with ground level in other ways, such as being set in concrete, for example, or being integrated with a support base that may be moved across the ground surface. As another example, the umbrella may instead be a canopy over, for example, a cabana, and may be supported by other elements of the structure of the cabana. There are many possibilities. The important elements to the present invention are the integration of the heater with the reflector, the hood and the cap as is described in enabling detail in various places in this specification with the aid of the figures included in the application.

A magnetic proximity switch may be located inside the collar connecting the tubular member 103 to the heater core. A magnet attached to collar 105 activates the proximity switch when the umbrella is in the open position allowing the controls on the heater core 111 to operate. The heater controls are disabled and the heater cannot operate when the umbrella is in the down position. Other types of switches may be used.

In one embodiment a timer switch 107 may augment the controls on heater core 111. Timer switch 107 may be a crank type or electronic timer switch that ignites the heater and counts off a number of minutes that heat will be generated by the unit once activated, after which the unit may automatically shut off. In one embodiment both switches are employed where switch 104 overrides timer switch 107 and shuts off the heater upon closing the umbrella regardless of time left on the timer.

The canopy configuration and mechanical elements for opening and closing the umbrella may be modified to accommodate for the diameter of heater 111 and a heat reflector 112 mounted over heater core 111. Therefore, canopy 110 folds down at a juncture just outside the major diameter of reflector 112.

Reflector 112 may be made from steel, aluminum, or a heat-reflecting resilient material. Reflector 112 and reflector ring 115 operate to reflect radiant heat back down into the vicinity below the umbrella. Reflector 112 also functions to capture and divert exhaust gases into the exhaust mixing chamber. Reflector 112 is set off of heater core 111 to allow exhaust gases to pass into the mixing chamber.

Umbrella mechanics include previously mentioned sleeve 105. Sleeve 105 is a hub for connecting to and operating umbrella canopy 110. A plurality of canopy struts 108 are pivotally connected to sleeve 105 at tabs 106 formed on sleeve 105. Canopy struts 108 are each pivotally connected to canopy ribs 109 supporting canopy 110 at connection points provided on the ribs past the outer diameter of reflector 112. Reflector 112 has a radial pattern of brackets 116, attached to the top surface thereof. Each bracket is fixed to the surface of the reflector and has connection to the ends of individual canopy ribs 109 past the outward edge of the reflector enabling closing and opening of the umbrella mechanics of unit 100 without contact interference from the heater core and or the reflector.

Hood 113 may also be described as an upper hood having an outer diameter that overlaps a central opening in canopy 110. Hood 113 does not bend or flex when the canopy is opened or closed, as the fixed brackets atop the reflector are connected to the canopy ribs at or beyond the outer diameter of the hood. In this embodiment the reflector is spaced apart from the heater core and hood 113 is spaced apart from the top of reflector 112 using spacers 117.

Unit 100 includes a cap 114. Cap 114 is an annular metallic cap or cover that blocks the path of a central exhaust opening above the heater core and creates the exhaust mixing chamber. Cap 114 is mounted centrally over hood 113 using spacers. In this way it is spaced above the top surface of the hood for exhaust cooling and venting purposes. More detail about mitigating heat distribution and exhaust is provided later in this specification.

In general operation of radiant heating unit 100, a user may open umbrella canopy 110 thereby activating the safety switch that enables use of the heater core controls to begin generation of radiant heating. This act may or may not include adding an timer to control the length of operation after activation. Activation may include opening a pressurized fuel valve to the heater core and electrically igniting a combustor to begin fuel combustion to generate heat. Reflector 112 and reflector ring 115 operate to reflect radiant heat back down from the heater under the open canopy thereby retaining as much heat as possible in the vicinity of users, allowing the use of less fuel.

In one embodiment there is a safety shut-off switch 104 that may be used to override other switches and shut the heater down if heat is overbearing or might lead to a safety issue.

Figure 2:
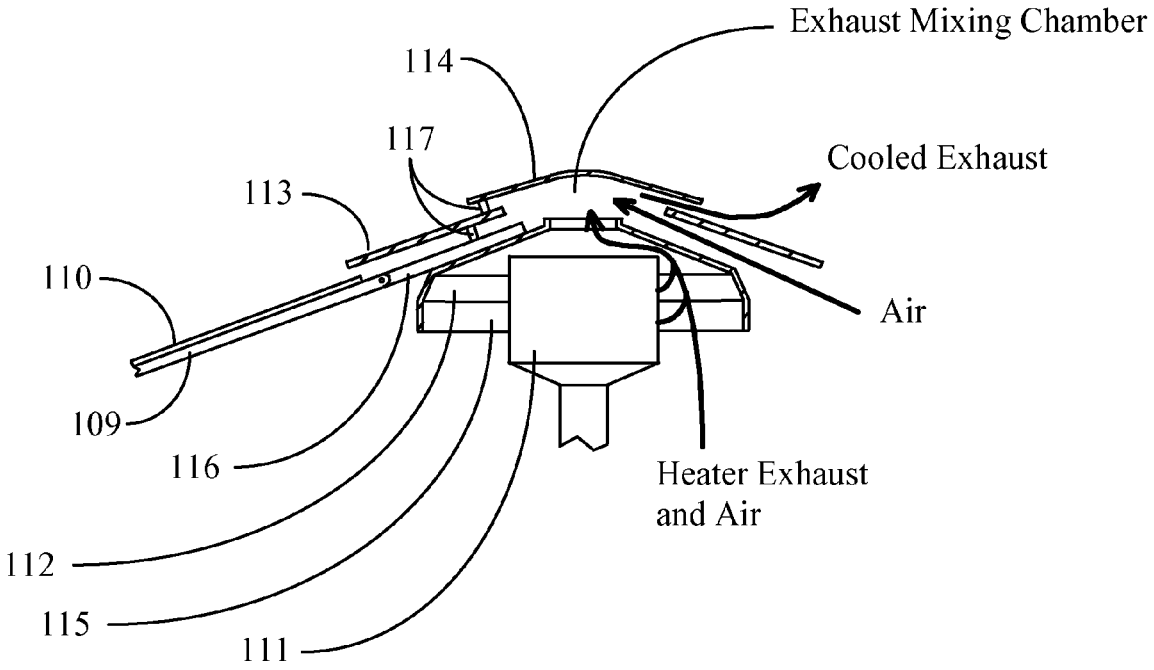
FIG. 2 is a section view showing the flow of heater exhaust and air into the mixing chamber and the exiting of cooled exhaust.

FIG. 2 is a partial section view of heater 100 showing the flow of exhaust gases from heater core 111, fresh air and cooled exhaust. The hot exhaust gases from the heater core 111 rise, and are reflected upward by the reflector 112 through the opening in the center of the reflector into the exhaust mixing chamber. Fresh air is pulled by convection through the space between the heater core 111 and the reflector 112, providing some immediate cooling as this air combined with the exhaust gases. Convection forces pull additional air through the annular space between hood 113 and cap 114 entering the mixing chamber. After mixing with the exhaust gases, the cooled exhaust flows out through the annular space between hood 113 and cap 114 around the entire perimeter of cap 114.

Figure 3:
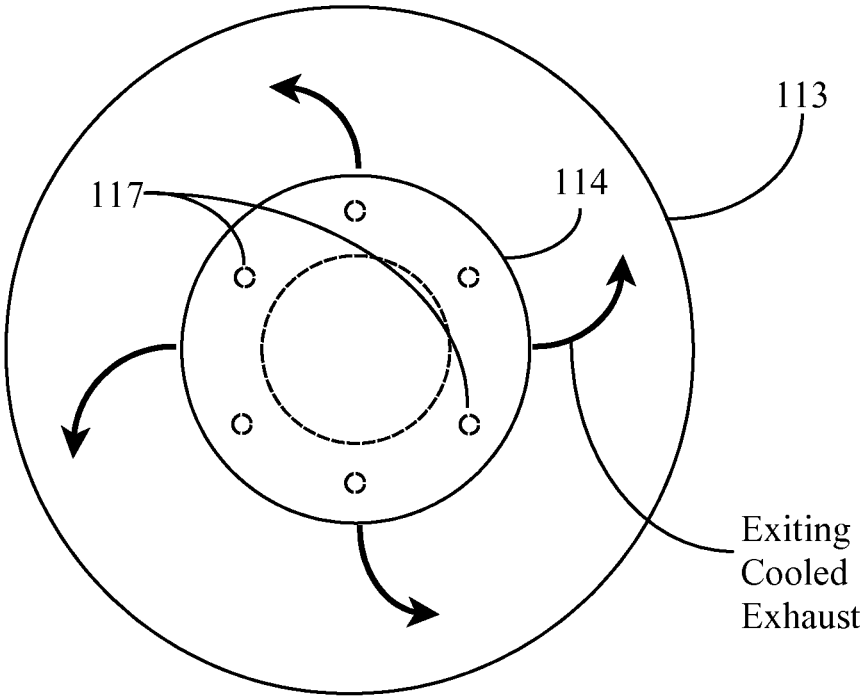
FIG. 3 is an overhead view of the cap and hood of FIG. 1.

FIG. 3 is an overhead view of cap 114 and hood 113 of FIG. 1. Hood 113 covers a central opening in the lower canopy preventing leakage or rain or other materials that might fall on top of the unit from interfering with components under the canopy including the heater, reflector, etc. Hood 113 lays over (overlaps) but is not physically connected to the lower canopy 110, and may be connected to brackets 116 (FIG. 5) by stand-off connectors.

Cap 114 is centrally positioned over hood 113 and mounted to the top surface of the hood using spacers 201. Cap 114 has a diameter large enough to adequately cover a central exhaust opening (broken circle) keeping weather and debris from entering beneath the canopy while the unit is in use. Hood 113 and cap 114 may be manufactured of sheet metal or aluminum, or some other metal material. Spacing cap 114 above hood 113 in mounting provides a vent for cool air above the canopy to enter the exhaust mixing chamber cooling rising exhaust from combustion collected by reflector 112. The rising, cooled exhaust is redirected from a vertically upward path to a substantially horizontal path between cap 14 and hood 113, allowing exhaust to escape from the periphery of cap 114, where the exhaust is cooled and expanded, and expands further outward and upward. This much larger circumference for exhaust flow guarantees a much cooler exhaust than in the prior art where the exhaust is directly upward from the burner through a small diameter chimney.

In one embodiment, hood 113 is a sheet metal structure having a pyramidal shape and formed from multiple, identical four-sided sections of sheet metal, the sections joined along their lateral edges. In this embodiment cap 114 is formed from an equal number of triangles. These faceted shapes may also be seamlessly formed by using available manufacturing processes. In other embodiments the hood may be smoothly circular without the separate sections.

Figure 4:
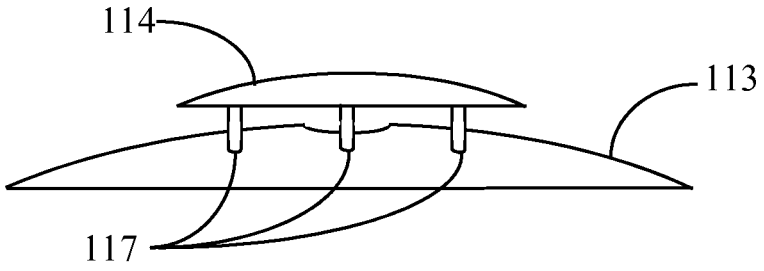
FIG. 4 is an elevation view of the hood and cap assembly of FIG. 3.

FIG. 4 is an elevation view of the hood assembly (113,114) of FIG. 3. Cap 114 is spaced above hood 113 by spacers 117. In this configuration the spacers are cylindrical and have openings at the ends for accepting screws. Openings provided through the surfaces of hood 113 and cap 114 enable fastening to the spacers. Spacers 117 may be of another shape than cylindrical without departing from the spirit and scope of the present invention. The number of spacers used may vary. In this example there are six spacers.

Hood 113 and cap 114 have a generally annular profile. Other profiles may be implemented without departing from the spirit and scope of the invention, such as a hexagonal profile for example. In function, cap 114 prevents weather (rain, snow, hail) and debris from falling into the exhaust opening. Rising exhaust gases are diverted outwardly by the presence of cap 114.

Figure 5:
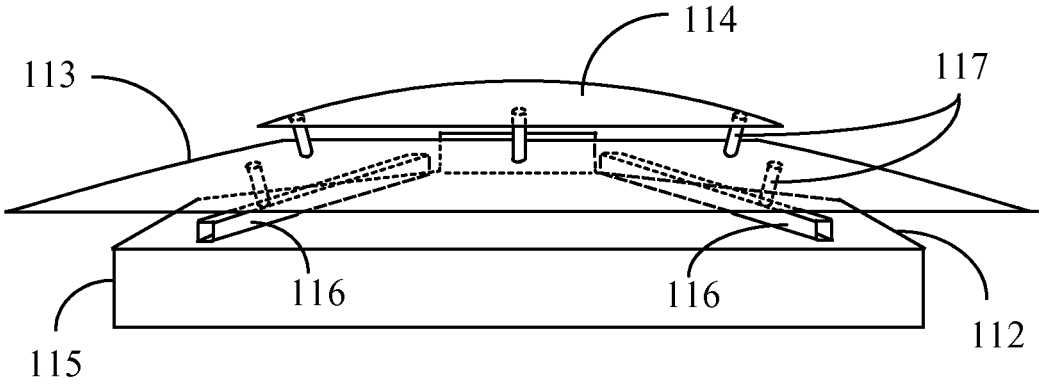
FIG. 5 is an elevation view of the hood and cap assembly of FIG. 4 mounted over the reflector of FIG. 1 according to an embodiment of the present invention.

FIG. 5 is an elevation view of the cap and hood assembly of FIG. 3 mounted over reflector 112 of FIG. 1 according to an embodiment of the invention. Reflector 112 has in this embodiment generally conical sections with the major diameters facing downward to help reflect or redirect radiant heat produced by heater core 111 downward toward users below the canopy. Reflector 112 has a vertically oriented ring 115 extending downward. Ring 115 functions to prevent radiant heat generated by heater core 111 from overheating the lower canopy fabric near the center opening of the canopy. The height of ring 115 may vary in different embodiments, but is generally of sufficient height to provide a lateral heat shield that prevents radiant heat from interacting with the underside of the lower canopy fabric. Prior to the present invention it was necessary to provide a ring of very expensive fireproof aluminized fabric to the underside canopy fabric near the reflector. The unique reflector ring 115 protects the inter-area of the canopy at low cost, and reflects heat that would otherwise be lost downward.

Reflector 112 has an upper opening above the heater for exhaust gases to pass into the exhaust mixing chamber below cap 114. A gap is provided by spacers under the reflector to allow cool air to be drawn into the exhaust flow to help cool the exhaust above heater core 111 before it enters the exhaust mixing chamber. In one embodiment, brackets 116, in one embodiment formed from square hollow steel stock, are mounted in a radial fashion onto the top surface of the reflector and are pivotally connected at the lower ends of the brackets to the canopy ribs as previously described. In this embodiment spacers 117 are mounted directly to the top surfaces of the brackets at one end and to the undersurface of the hood at the other end, spacing the hood above the reflector by the length of the spacers 117. In another embodiment the spacers may be mounted separately from the brackets.

An important purpose of the present invention is to provide a safe design to minimize the temperature of the reflector and the hood in operation. In apparatus before the present invention temperatures were so high that spacers 117 had to be ceramic material, which did not perform well over time. With the present design ceramic spacers are no longer necessary.

It will be apparent to the skilled artisan that the construction of the top portion of the heating unit above the heater core (111) in embodiments of the present invention enables cooling of gases in the exhaust flow while preventing debris and weather from inundating the exhaust pathway through gaps left by spacing the components apart from one another in mounting. The radiant heating system of the invention may be provided using some or all of the mentioned features and components without departing from the spirit and scope of the present invention. It will also be apparent to the skilled artisan that the embodiments described above are specific examples of a single broader invention that may have greater scope than any of the singular descriptions taught. There may be many alterations made in the descriptions without departing from the spirit and scope of the present invention. The invention is limited only by the breadth of the claims below.

The invention claimed is:

1. An apparatus comprising:

a fuel-burning radiant heater having a vertically-oriented central axis, an outside diameter, and a vertical length between an upper and a lower extremity, radiating heat outwardly from a cylindrical outer surface, and discharging exhaust gases upwardly from the upper extremity;

a metal reflector structure surrounding and concentric with the radiant heater, the reflector structure having an upper circular opening at an upper extremity having a diameter lesser than the diameter of the radiant heater, a first conical section opening downward having a first angle with the vertically-oriented central axis, a second conical section opening downward from the first conical section, having a second angle with the vertically-oriented central axis lesser than the first angle of the first conical section, and a cylindrical section extending downward from the second conical section, walls of the cylindrical section being parallel with the central axis, the cylindrical section ending at a lower extremity of the reflector structure, the reflector structure positioned relative to the radiant-heater such that the upper circular opening is directly over the upper extremity of the radiant heater, the first conical section clears the radiant heater, leaving an annular passage for air and products of combustion between the first conical section and the radiant heater, and the lower extremity of the reflector structure is positioned at a height below a midpoint of the vertical length of the radiant heater, thus blocking a substantial part of radiant heat directed outward from passing beyond the reflector structure;

a metal hood having no contact with canopy fabric, the hood shaped as a truncated cone with an open upper extremity having a diameter greater than that of the upper circular opening of the reflector structure, a hood opening concentric with and greater in diameter than the upper circular opening of the reflector, a cone angle with the central axis substantially the same as the first angle of the first conical section of the reflector, and a lower extremity having a diameter substantially greater than diameter at the lower extremity of the reflector, the hood positioned at a height that the upper extremity of the hood is level with or above the upper extremity of the reflector, with the hood evenly spaced above the reflector, providing an annular outer opening between the hood and reflector; and a downward-facing dome-shaped cap having an outside diameter greater than the diameter of the open upper extremity of the hood and less than diameter of the lower extremity of the hood, the cap spaced apart from the hood by spacers, providing an annular space between the cap and the hood of substantially a common height;

wherein exhaust gases emitted upwardly from the radiant heater pass through the upper circular opening of the reflector, drawing air and exhaust gases through the annular passage between the first conical section of the reflector and the radiant heater, and additional cooler air through the annular space between the reflector and the hood, into a mixing chamber formed by the cap, the hood and the reflector, where the cooler air and the exhaust gases mix and the mixed air and exhaust gases then pass outward through the annular space between the cap and the hood, exiting the apparatus at the outer perimeter of the cap above the hood.

2. The apparatus of claim 1 further comprising a post supported on a ground-level base, the post supporting the radiant heater, the reflector structure, the metal hood and the cap as an assembly.

3. The apparatus of claim 2 further comprising outwardly-extending first struts joined to the reflector, and second struts vertically hinged to outer ends of the first struts, the second struts supporting a fabric canopy with no contact to the metal hood, such that the fabric canopy forms an umbrella that may be raised and lowered.

4. The apparatus of claim 3 further comprising a sliding collar on the post having ribs pivotally joined to both the collar and at a point on the struts, such that sliding the collar up and down raises and lowers the umbrella.

5. The apparatus of claim 4 further comprising a proximity switch in the post sensing the collar, such that, at a specific point in lowering the umbrella the heater is disabled.

6. The apparatus of claim 1 further comprising an electronic or mechanical switch to ignite the heater and to count off the number of minutes that heat will be generated by the unit.

* * * * *